US006032974A

United States Patent [19]

Saillet

[11] Patent Number: 6,032,974

[45] **Date of Patent: *Mar. 7, 2000**

[54] DEVICE FOR RETAINING A BOOT ON A GLIDING BOARD ADAPTED FOR SNOWBOARDING

[75] Inventor: Benoit Saillet, Albens, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,649

[22] Filed: Apr. 29, 1997

[30] Foreign Application Priority Data

Jun. 3, 1996 [FR] France ..... 96 05671

[51] Int. Cl.[7] ..... A63C 5/07; A63C 9/08; F16F 9/18

[52] U.S. Cl. ..... 280/611; 280/11.36; 280/14.2; 280/619; 280/634; 280/602; 267/124; 267/129

[58] Field of Search ..... 280/14.2, 11.3, 280/11.36, 611, 619, 634, 11.115, 124.177, 602, 607; 267/124, 129

[56] References Cited

U.S. PATENT DOCUMENTS

| | | | |
|---|---|---|---|
| 249,964 | 11/1881 | Macomber | 280/11.36 |
| 983,721 | 2/1911 | Irish | 280/11.36 |
| 2,424,198 | 7/1947 | Tauscher | 267/129 |
| 3,870,325 | 3/1975 | Davis | 280/11.35 N |
| 3,945,134 | 3/1976 | Ramer | 36/2.5 AL |
| 4,476,640 | 10/1984 | Aldinio et al. | 36/121 |
| 5,020,823 | 6/1991 | Bogner | 280/634 |
| 5,106,065 | 4/1992 | Staton et al. | 267/124 |
| 5,702,091 | 12/1997 | Perrin et al. | 267/124 |
| 5,865,445 | 2/1999 | Svensson et al. | 280/11.2 |

FOREIGN PATENT DOCUMENTS

| | | | |
|---|---|---|---|
| WO 83/02397 | 7/1983 | European Pat. Off. | 280/11.36 |
| 351 881 | 1/1990 | European Pat. Off. | 280/634 |
| 54.219 | 10/1945 | France | 280/11.36 |
| 60.630 | 11/1954 | France | 280/619 |
| 2063622 | 7/1971 | France . | |
| 2650752 | 2/1991 | France . | |
| 3622746 | 1/1988 | Germany . | |
| 8902125 | 6/1989 | Germany . | |

*Primary Examiner*—Paul N. Dickson
*Assistant Examiner*—Bridget Avery
*Attorney, Agent, or Firm*—Greenblum & Bernstein, P.L.C.

[57] ABSTRACT

The invention relates to a device for retaining a boot on a gliding board. The device includes especially a dorsal support element and a base, the dorsal support element being journalled on the base along a substantially transverse Y–Y' axis of the device, wherein at least one braking mechanism opposes a journal movement of the dorsal support element with respect to the base along the Y–Y' axis, in at least one journal direction, and wherein a return mechanism maintains the dorsal support element substantially in contact with the lower part of the leg.

22 Claims, 4 Drawing Sheets

3
10
5
F
37
2
9
8
IV
26
22
27
38
20
17
16
12
13
6
7
29
28
1
4
Y.Y'
11
14
25
IV 3
10
F
39
2
9
X
X'
IV
26
8
27
40
20
17
16
6
12
13
29
7
1
4
Y.Y'
11
14
25
28
IV

DEVICE FOR RETAINING A BOOT ON A GLIDING BOARD ADAPTED FOR SNOWBOARDING

BACKGROUND OF THE INVENTION

1. Field of the Invention

The present invention relates to means for retaining a boot on a gliding board adapted for snowboarding. More particularly, the invention relates to means for retaining a boot that allows for bending or inclination movements of the leg with respect the user's foot.

2. Background and Material Information

In snowboarding, the user operates his board on trajectories that can be substantially straight or curved. In any case, the operation can be precise only if the supports of the board on the snow are controlled by the user.

Experience shows that control of the supports is readily done when the trajectories are relatively straight, but that control is delicate, or even impossible when the trajectories are curved.

Indeed, the user is always led to make movements with the body or limbs to manage his balance at the same time as he operates his board. It has proven very difficult to perfectly coordinate balance management and board operation in curved trajectories, in turns or on a bump.

In fact, the movements made to maintain the balance disturb the control of the supports that is necessary for a precise operation. In particular, when the user bends or inclines the legs to maintain balance, he cannot, at the same time, avoid causing a change, sometime severe, in the inclination of the board with respect to the ground.

This change in the inclination generally has the effect of severely modifying the contact surface of the board on the ground. As a result, the operation is disturbed and the control of the trajectory is random, because the reaction forces of the ground on the board vary in considerable proportions.

This phenomenon is particularly notices when the user needs to keep balance and to press toward the ground with the side of the board located behind him.

The prior art has proposed devices that provide a certain positioning flexibility between each foot and the board.

It is, for example, the case of the document FR 2 650 752 whose object is to enable the user to place himself in the most comfortable and balanced position during the displacements, due to flexible journals arranged between the feet and the board. The device according to the document FR 2 650 752 does not, however, enable the user to manage the variations in the support. Indeed, the flexibility of the journals does not promote a precise guiding, and does not enable the user to properly identify the sensorial information which he receives. Therefore, this devices is not really satisfactory, and mastering the trajectories is difficult, even impossible.

The document DE 89 02 125 proposes a device for retaining a boot on a board which includes a journalled shell on a base along a transverse axis. The journal enables the device to be folded for transportation. A removable elastic means is capable of maintaining the shell with respect to the base in a usage position. The elastic means acts to limit the bending movement of the lower part of the leg toward the foot. It follows that the user can easily take supports with the forefoot.

On the contrary, it is not possible for the user to easily master curved trajectories because of the elasticity of the device. In particular, it is practically impossible to keep a selected curved trajectory in the case where it is necessary to manage both the balance and the support on the ground with the side of the board located behind the user.

SUMMARY OF THE INVENTION

The object of the invention is to remedy the aforementioned disadvantages. To this end, it proposes a device for retaining a boot on a gliding board, the device including especially a dorsal support element to ensure rear support of the lower part of the leg and a base adapted to receive the sole of the boot, the dorsal support element being journalled on the base along a substantially transverse Y–Y' axis of the device.

At least one braking means, according to the invention, opposes a journal movement of the dorsal support element with respect to the base along the Y–Y' axis, in at least one journal direction.

This structure makes it possible to absorb the journal movement along each direction in which the braking means acts. Only sensorial information useful to the operation passes through the device in the movement along this direction, while interfering vibrations are absorbed. The user can therefore advantageously operate the board with a better control.

Also, a return means, according to the invention, maintains the dorsal support element substantially in contact with the lower part of the leg. As a result, the dorsal support element is constantly in contact with the lower part the leg. Therefore, the braking means acts, in each of the possible directions, as soon as the lower part of the leg is displaced. The advantage is that the control of the operation is instantaneous.

Preferably, according to the invention, the braking means opposes the journal movement with respect to the Y–Y' axis of the dorsal support element with respect to the base in a front-to-rear direction.

Therefore, when the user stretches the legs after bending, the return of the dorsal support element into position occurs progressively. The user can advantageously take his rear supports with proper progressiveness.

According to an embodiment, the dorsal support element is monoblock, i.e., made as a unitary element. This structure provides the device with a lateral rigidity with respect to the foot that is suited for operation in a turn.

According to another embodiment, the dorsal support element includes a shell and an arch journalled with respect to one another along an X–X' axis located in a substantially longitudinal plane of the device. This structure provides the device with a degree of lateral freedom for the lower part of the leg with respect to the foot that is suited for executing style figures.

A stop means limits the journal movement of the dorsal support element with respect to the base along the Y–Y' axis in a direction in which the lower part of the leg extends with respect to the foot, or front-to-rear direction.

Therefore, the user can take a rigid rear support on the ground when he does not have to severely change his balance.

According to an alternative embodiment, at least one elastic means cooperates with the braking means. Preferably, the elastic means constantly biases the dorsal support element with respect to the base according to a journal movement along the Y–Y' axis in a rear-to-front direction.

This structure promotes the bending movements of the legs of the user who can advantageously bend forward sharply.

According to an embodiment, the elastic means is a compression spring of which one end biases the dorsal support element, and whose other end biases the base, in a spacing direction, and in that the braking means is a fluid contained in a sheath. This structure makes the device resistant to moisture.

According to an alternative embodiment of the device according to the invention the elastic means is a compression spring of which one end biases the dorsal support element, and whose other end biases the base, in a spacing direction, and in that the braking means is a friction seal that is affixed to a rod and slides within the sheath.

The advantage is that the spring eliminates the snow wedges, and that the shock absorber is easy to manufacture.

According to another alternative embodiment, the elastic means is a torque spring of which one end is connected to the dorsal support element, and whose other end is connected to the base, and the braking means includes at least one layer of viscoelastic material associated with two toothed wheels.

The advantage of this structure is that the viscoelastic material renders the device resistant to moisture.

Yet according to another alternative embodiment of the invention the elastic means is a torque spring of which one end is connected to the dorsal support element, and whose other end is connected to the base, and the braking means is a friction disk associated with two toothed wheels. This alternative embodiment has the advantage of being compact.

BRIEF DESCRIPTION OF DRAWINGS other characteristics and advantages of the invention will be better understood along the description that follows, with reference to the annexed drawings showing, by way of non-limiting examples, how the invention can be embodied, and in which:

FIG. 1 is a perspective view of a gliding board with two retaining devices according to one embodiment;

FIG. 1*a* is an enlargement of a retaining device of FIG. 1;

DETAILED DESCRIPTION OF THE PREFERRED EMBODIMENTS

Figure 1:
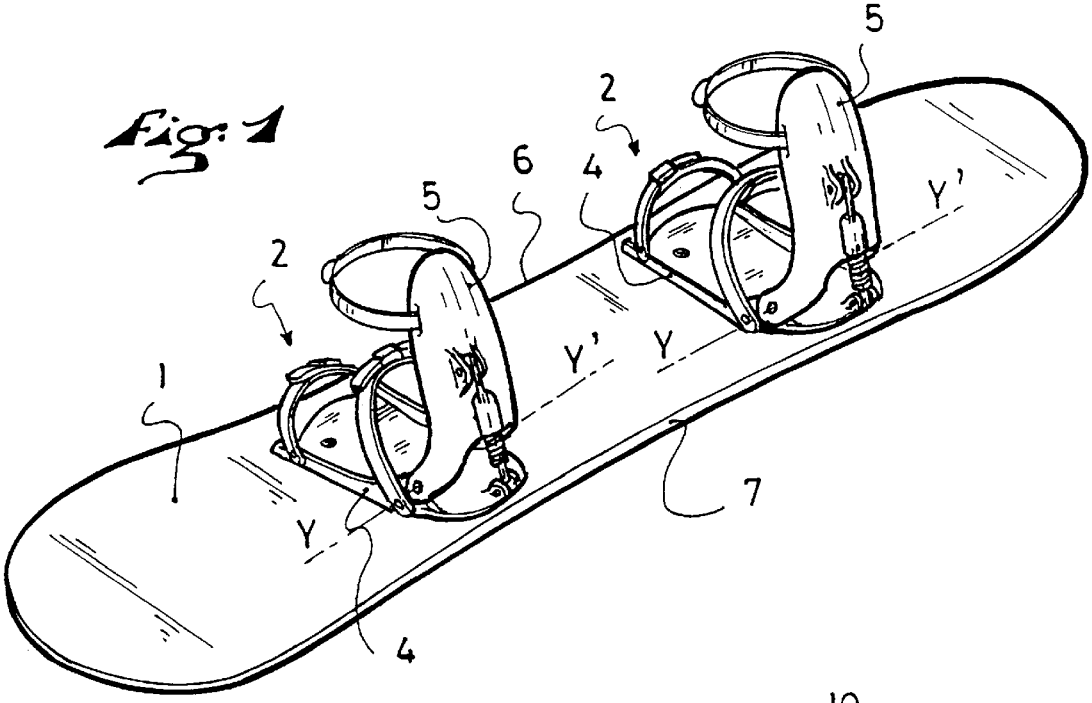
Figure 1A:
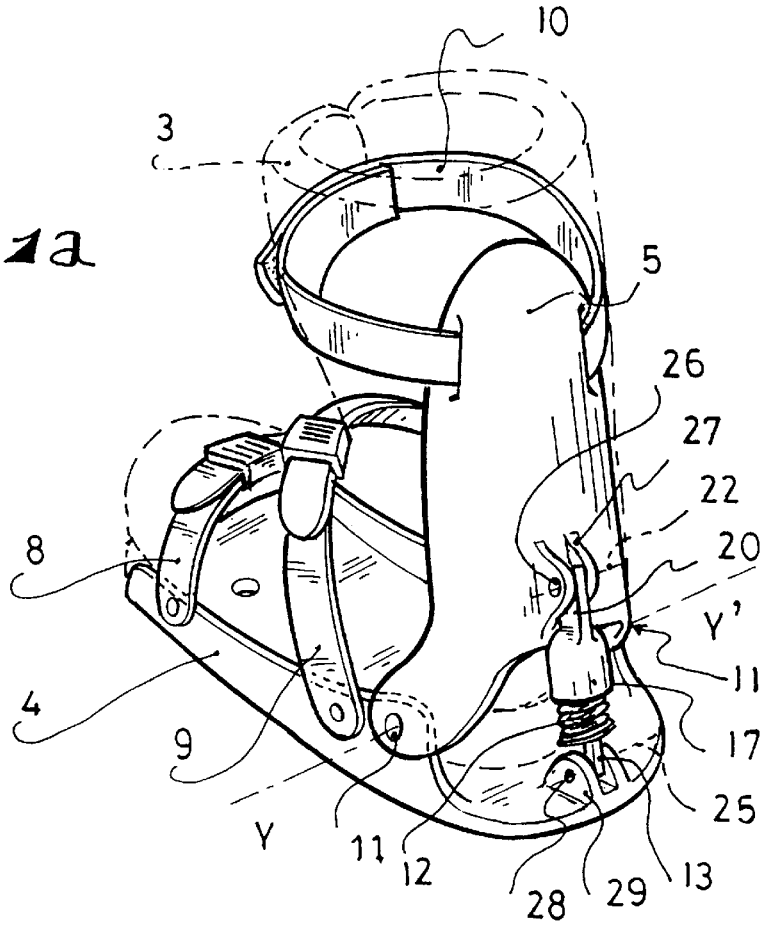

FIGS. 1 and 1*a* show a gliding board 1 on top of which two devices 2 for retaining the boots 3 of a user are attached. Each device 2 includes a base 4 for holding the foot and a dorsal support element 5 for taking support especially in turns where the user presses on the rear running edge and has his back facing the slope. The devices 2 are respectively oriented in a substantially transverse direction of the board 1, such that the tips of the feet are close to a frontal longitudinal side 6, and that the heels are close to a rearward longitudinal side 7 of the board 1.

Each device 2 includes means for retaining the boot 3 on the device 2, which means are represented by straps 8, 9, maintaining the boot 3 on the base 4 at the level of the foot, and includes a means for returning the dorsal support element on the lower part of the leg, which means is represented by a strap 10 maintaining the boot 3 on the dorsal support element 5 at the level of the lower part of the leg.

On each device 2, the dorsal support element 5 is journalled with respect to the base 4 by a journal connection, which is represented here in the form of rivets 11, such that the dorsal support element 5 can pivot with respect to the base 4 about a substantially transverse Y–Y' axis of the device 2. The Y–Y' axis is transverse with respect to a longitudinal direction of the device 2 extending substantially from the toes toward the heel of the foot. In the illustrated embodiment, the base 4 is shaped like a cradle, having a surface that receives the lower surface of the sole of the boot and a pair of laterally opposed upwardly extending portions. The rivets 11, or other journal connections, connect the dorsal support element 5 and the upwardly extending portions of the base 4.

According to the spirit of the invention, an elastic means constantly biases the dorsal support element 5 with respect to the base 4 along a rotational movement with respect to the Y–Y' axis in a bending direction of the lower par of the leg toward the foot. This elastic means can be a compression spring 12 that is visible in FIGS. 1, 1*a*, 2, 3, 4.

Figure 4:
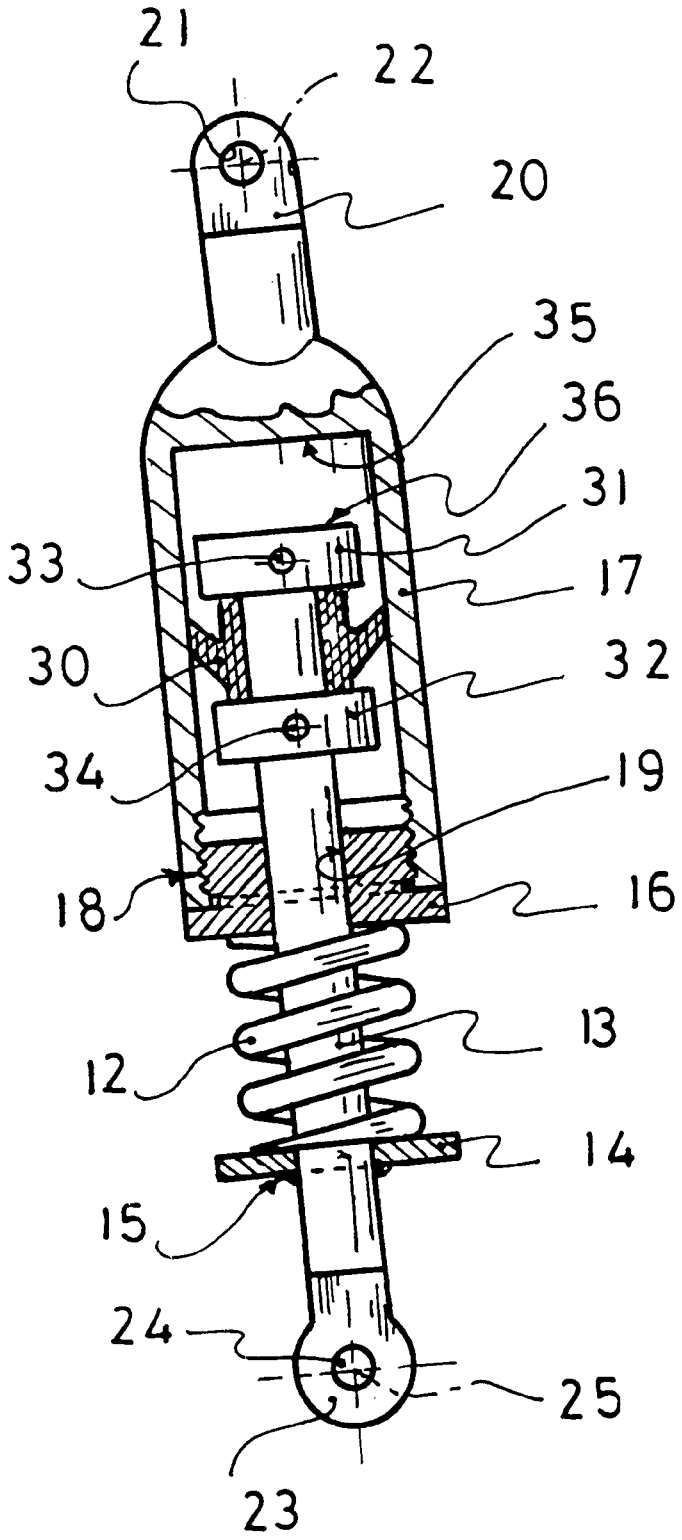
FIG. 4 is a cross-section along the line IV—IV of FIG. 2 or 3.

As shown in FIG. 4, the spring 12 is guided by a rod 13 having a cylindrical section. The spring 12 takes support on one of its ends on a retainer 14 affixed to the rod 13 by any suitable means, such as a weld 15. The spring 12 takes support through the other end on a plug 16 which is itself fixed on a cylinder or sheath 17, for example, by means of a thread 18. The plug 16 is bored in its center by a hole 19 which serves to guide the rod 13 in a direction of compression or extension of the spring 12. The sheath 17 is extended at its end that is opposite the plug 16 by a flat portion 20 bored by a hole 21 having an axis 22. The rod 13 is extended at its end that comes out of the hole 19 by a flat portion 23 bored by a hole 24 having an axis 25.

The rod 13 is therefore capable of penetrating into the sheath 17 against the action of the spring 12 by being guided in the sheath 17 through the hole 19 of the plug 16.

In practice, as shown in FIGS. 1 and 1*a*, the sheath 17 is journalled by the axis 22 common to a pin 26, to the hole 21 of the flat portion 20, and to two openings of a base 27, on the dorsal support element 5.

The rod 13 is journalled by the axis 25 common to a pin 28, to the hole 24 of the flat portion 23, and to two openings of a base 29, on the base 4.

As the spring 12 constantly biases the retainer 14 and the plug 16 in a spacing direction, the dorsal support element 5 and the base 4 are constantly biased in the direction of bending of the boot 3.

As shown in FIG. 4, a braking means, or brake, constantly absorbs a penetrating movement of the rod 13 into the sheath 17. This braking means is represented here in the form of a seal 30 having a circular lip, the lip being oriented in a direction that opposes the entry of the rod 13, but does not prevent the exit thereof.

The seal 30 is retained on the rod 13 by any suitable means, such as two rings 31, 32, which are themselves immobilized on the rod 13 by two pins 33, 34.

A mechanism for stopping the displacement of the dorsal support element 5 with respect to the base 4 in a direction of extension of the foot is made, for example, by association of the end 35 of the sheath and of the top 36 of the rod 13. When the end 35 and the top 36 are in contact, the spring 12 is in a maximum compression state.

The retaining device thus made enables a user to rapidly and easily bend the legs while biasing the rearward longitudinal side 7 of the board 1 toward the ground, due to the action of the constant action of the spring 12. A permanent contact is subsequently obtained between the rearward side 7 and the ground in the turns or on the bumps where the user has his back facing the slope of the terrain. The movements of the body and of the legs made to maintain the balance do therefore not disturb the operation of the board 1.

Of course, all of the known techniques and materials can be used to embody the invention.

In particular, one can provide to make the sheath out of a metal such as aluminum, or out of plastic or composite materials. The plug 16 could be made of bronze, the rod 13 of steel, the spring 12 of steel alloy. The lip seal 30 is preferably made of rubber or molded polyurethane.

Figure 2:
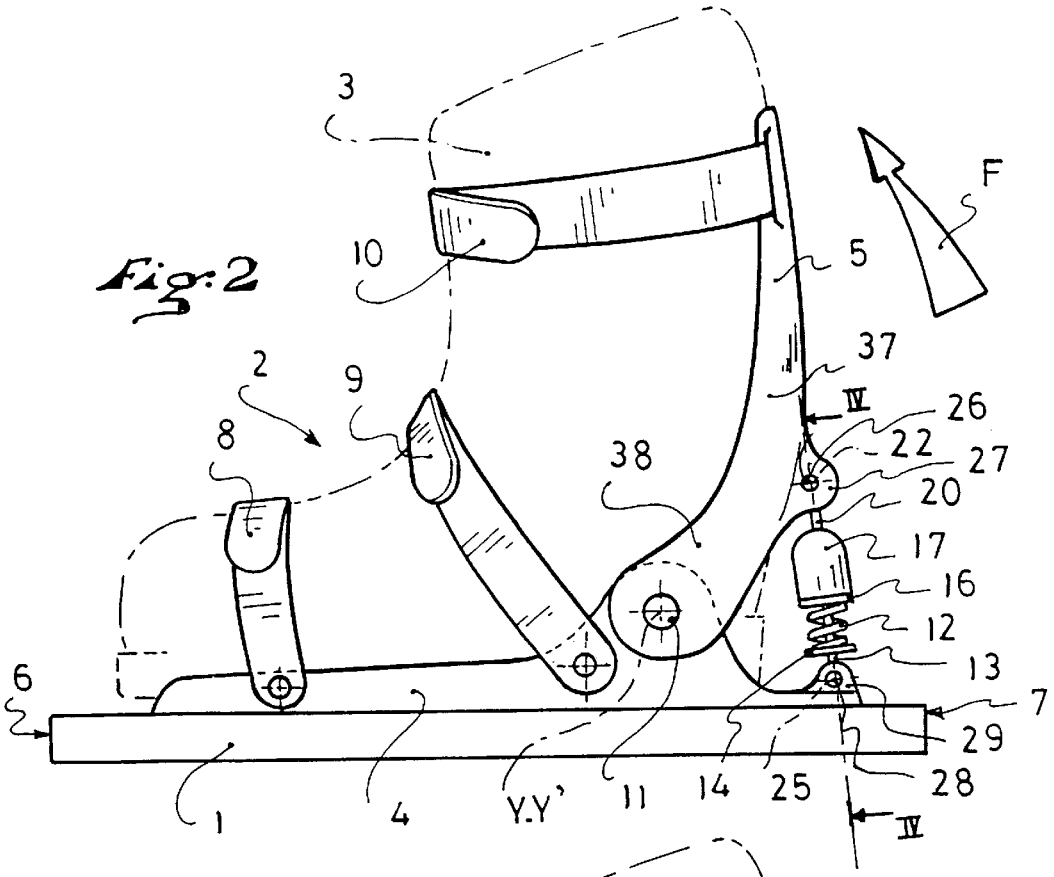
FIG. 2 is a lateral view of a retaining device of FIG. 1.
Figure 3:
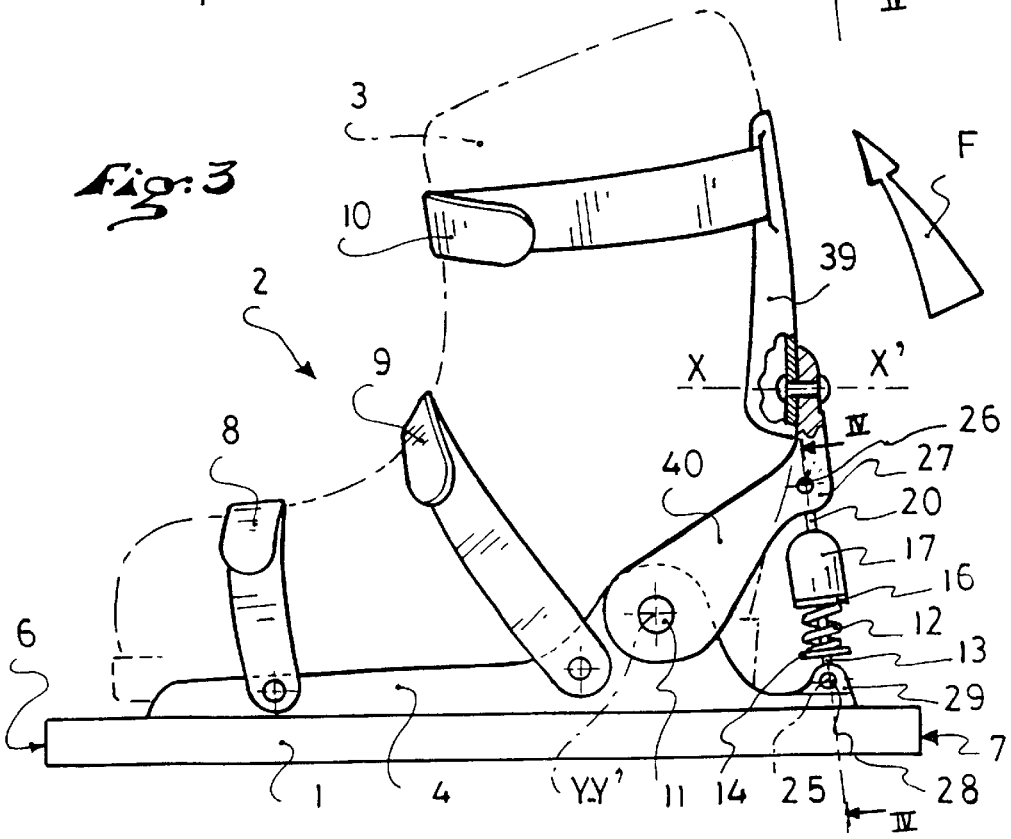
FIG. 3 is similar to FIG. 2 but corresponds to an alternative embodiment.

Two variations of the embodiment described appear in a lateral view in FIGS. 2 and 3.

In FIG. 2, the dorsal support element 5 includes a shell 37 and an arch 38 forming a single block, made for example of injected plastic material.

In FIG. 3, the dorsal support element 5 includes a shell 39 journalled on an arch 40 along a substantially longitudinal X–X' axis of the boot. The journal can be embodied as to a rivet or any other means and facilitates lateral inclinations of the lower part of the leg along the X–X' axis.

For these two alternative embodiments, the spirit of the invention remains unchanged. Indeed, the spring 12 constantly biases the lower part of the leg in flexion with respect to the foot in the direction of arrow F, by acting constantly between the arch 38 or 40 and the base 4 in a respective spacing direction.

Figure 5:
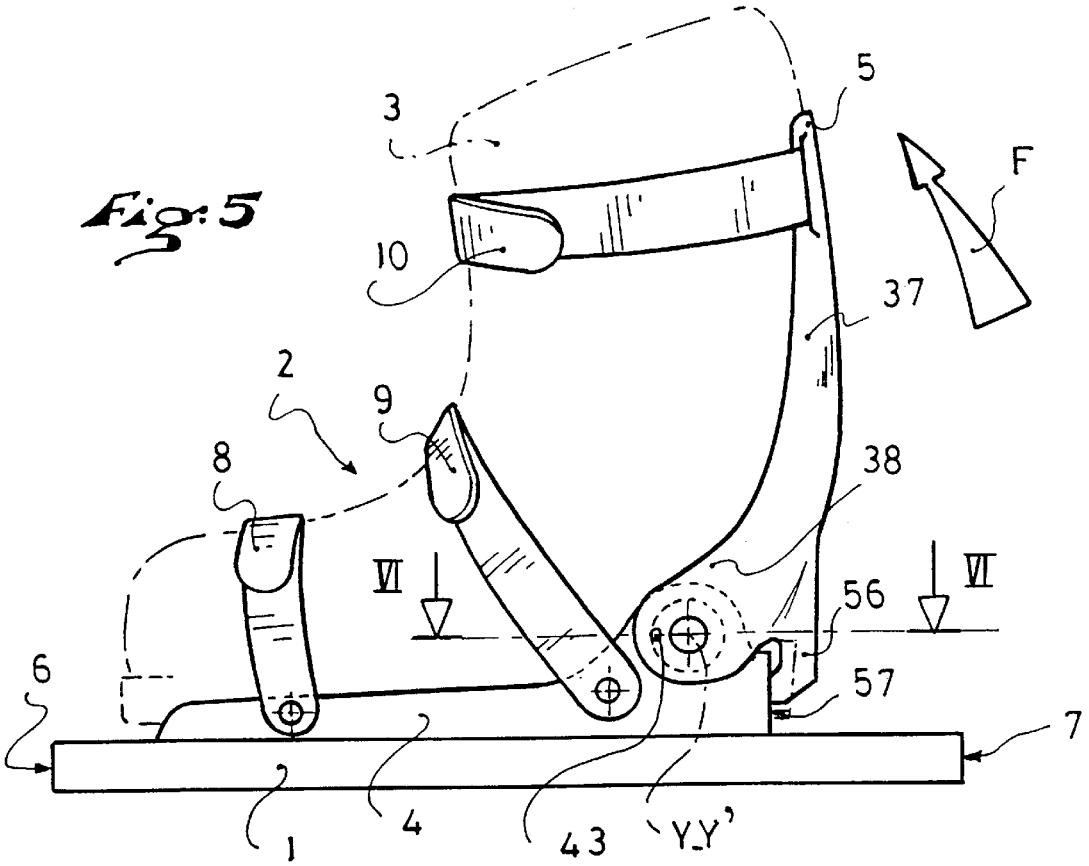
FIG. 5 is a lateral view of a retaining device according to another embodiment.
Figure 6:
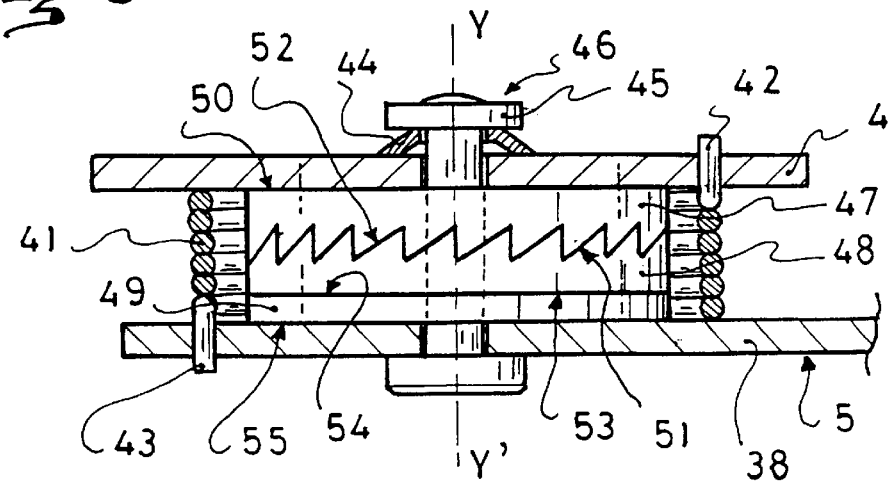
FIG. 6 is a cross-section along the line VI—VI of FIG. 5.

Another embodiment of the invention is proposed by means of FIGS. 5 and 6. For convenience, the same elements are designated by the same reference numerals.

A dorsal support element 5 including a shell 37 and an arch 38 are journalled on a base 4 along a substantially transverse Y–Y' axis.

As shown in the cross-section of FIG. 6, a torque spring 41 constantly acts between the base 4 and the arch 38 to bias the arch 38 and maintain the contact between the boot 3 and the shell 37. Indeed, ends 42 and 43 of the spring 41 are affixed to the base 4 and to the arch 38, respectively, by passing through holes of the base 4 and of the arch 38. The spring 41 remains in place due to the constant bias of an elastic washer 44 that is inserted between the base 4 and a shoulder 45 of a rivet 46 having a Y–Y' axis.

The rivet 46 serves to maintain the base 4 and the arch 38 with respect to one another, and it also serves as a rotational guide for a wheel 47, a wheel 48 and a disk 49, which are all pierced in their center for the passage of the rivet 46, and are all located between the base 4 and the arch 38.

The wheel 47 includes a flat side 50 affixed to the base 4 by any means, such as adhesion, and a toothed side 51 opposite the flat side 50.

The wheel 48 includes a toothed side 52 whose contour is complementary to the side 51 of the wheel 47, and a flat side 53 affixed to the disk 4 by any means, such as adhesion.

The disk 49 includes a side 54 affixed to the wheel 48, and a side 55 capable of sliding on the arch 38.

The toothed wheels 47 and 48 behave like a free ratchet wheel allowing a single direction of rotation with respect to the Y–Y' axis. The disk 49 behaves like a brake which dissipates the energy by friction.

During operation, a displacement of the arch 38 with respect to the base 4 in the direction of arrow F of FIG. 5 is rapid and easy, whereas a reverse displacement is braked by the friction exerted between the surfaces that are common to the disk 49 and to the arch 38. Thus, as with the brake, or braking mechanism, disclosed above, the brake of FIGS. 5 and 6 oppose the movement of the arch 38 rearwardly with a determinate braking force, while not opposing movement of the arch forwardly with such determinate braking force.

Indeed, the teeth of the wheels 47 and 48 are capable of being displaced with respect to one another when the arch 38 is displaced so as to allow for a bending of the foot, because the elasticity of the washer 44 enables a slight relative displacement in a spacing direction of the constituent walls of the arch 38 and of the base 4, subsequently to the action of the teeth. Of course, the inclination of the teeth acts in a single direction. When the leg makes a stretching movement with respect to the foot, the arch 38 stretches the spring 41 and the teeth of the wheels 47 and 48 remain in mesh. In this case, the wheels 47 and 48 and the disk 49 rotate together, the disk 49 sliding on the arch 38 from its side 55.

The movement of the arch 38 and of the shell 37 in the direction opposite the arrow F is limited by an abutment 56 which rests on a surface 57 of the base 4. The technical effects of this embodiment of the invention are identical to those of the first embodiment.

One can provide to make the spring 41, the toothed wheels 47, 48, and the elastic washer 44 out of metal or metallic alloy. The rivet 46, the base 4 and the arch 38 can be made of metal or synthetic material shaped by any known means such as injection or machining.

Of course, the invention is not limited to the embodiments thus described, and includes all of the technical equivalents that fall within the scope of the claims that follow.

In particular, one can envision to eliminate the straps 8, 9, 10, and to replace them by any automatic fitting system that can be inserted between the boot 3 and the base, or that can be located on one or more sides of the boot 3, and that includes a return means for the dorsal support element 5.

One can also provide an intermediate element between the boot 3 and the base 4, the boot 3 being maintained on the intermediate element by the straps 8, 9, 10, and the intermediate element being maintained on the base 4 by an automatic ratchet retention means. In this way, the user can optionally detach the straps 8, 9, 10, or the automatic ratchet retention means, depending on the conditions of practice and usage of the gliding board 1.

One can also provide to use a plurality of springs, for example two, arranged on both sides of the dorsal support element 5.

The instant application is based on French Priority Patent Application No. 96 05671, filed on May 02, 1996, the disclosure of which is hereby expressly incorporated by reference thereto, and the priority of which is hereby claimed under 35 U.S.C. 119.

What is claimed:

1. A device for retaining a boot on a gliding board adapted for snowboarding, said device comprising:

a dorsal support element for ensuring rear support of a lower part of a leg of a wearer of the boot;

a base adapted to be attached to the gliding board and adapted to receive a sole of the boot, said dorsal support element being journalled on said base along a substantially transverse axis of the device for journalled movement of said dorsal support element in a forward direction and in a rearward direction;

at least one strap maintaining said dorsal support element substantially in contact with the boot at the lower part of the leg; and at least one brake, said brake having a structure that opposes said journalled movement in said rearward direction with a determinate braking force, said structure of said at least one brake not opposing said journalled movement in said forward direction with said determinate braking force.

2. A device for retaining a boot on a gliding board according to claim 1, wherein:

said dorsal support element is a unitary element.

3. A device for retaining a boot on a gliding board according to claim 1, wherein:

said dorsal support element comprises:

an arch journalled on said base along said substantially transverse axis of the device; and a shell, said arch and said shell being journalled with respect to one another along an axis extending substantially longitudinally of the device.

4. A device for retaining a boot on a gliding board according to claim 1, further comprising:

a stop mechanism to limit said journalled movement in said rearward direction.

5. A device for retaining a boot on a gliding board according to claim 1, further comprising:

at least one elastic means cooperating with said at least one brake.

6. A device for retaining a boot on a gliding board according to claim 5, wherein:

said at least one elastic means comprises an elastic means for constantly biasing said dorsal support element with respect to said base in said forward direction.

7. A device for retaining a boot on a gliding board according to claim 5, wherein:

said at least one elastic means comprises a compression spring, said compression spring having one end biasing said dorsal support element and another end biasing said base in a direction spacing apart said dorsal support element and said base; and said at least one brake comprises a friction seal affixed to a rod sliding within a sheath.

8. A device for retaining a boot on a gliding board according to claim 6, wherein:

said at least one elastic means comprises a compression spring, said compression spring having one end biasing said dorsal support element and another end biasing said base in a direction spacing apart said dorsal support element and said base; and said at least one brake comprises a friction seal affixed to a rod sliding within a sheath.

9. A device for retaining a boot on a gliding board according to claim 5, wherein:

said at least one elastic means comprises a compression spring, said compression spring having one end biasing said dorsal support element and another end biasing said base in a direction spacing apart said dorsal support element and said base; and said at least one brake comprises a fluid contained in a sheath.

10. A device for retaining a boot on a gliding board according to claim 6, wherein:

said at least one elastic means comprises a compression spring, said compression spring having one end biasing said dorsal support element and another end biasing said base in a direction spacing apart said dorsal support element and said base; and said at least one brake comprises a fluid contained in a sheath.

11. A device for retaining a boot on a gliding board according to claim 5, wherein:

said at least one elastic means comprises a torque spring, said torque spring having one end connected to said dorsal support element and another end connected to said base; and said at least one brake includes at least one layer of viscoelastic material associated with a pair of toothed wheels.

12. A device for retaining a boot on a gliding board according to claim 6, wherein:

said at least one elastic means comprises a torque spring, said torque spring having one end connected to said dorsal support element and another end connected to said base; and said at least one brake includes at least one layer of viscoelastic material associated with a pair of toothed wheels.

13. A device for retaining a boot on a gliding board according to claim 5, wherein:

said at least one elastic means comprises a torque spring, said torque spring having one end connected to said dorsal support element and another end connected to said base; and said at least one brake comprises a friction disk associated with a pair of toothed wheels.

14. A device for retaining a boot on a gliding board according to claim 6, wherein:

said at least one elastic means comprises a torque spring, said torque spring having one end connected to said dorsal support element and another end connected to said base; and said at least one brake comprises a friction disk associated with a pair of toothed wheels.

15. In combination, a snowboard and two spaced apart devices for retaining respective boots on said snowboard, said combination comprising:

a longitudinally extending snowboard, said snowboard having a frontal longitudinal side, a rearward longitudinal side, and an upper surface;

two devices for retaining respective ones of a pair of boots on said snowboard, said devices being adapted to be longitudinally spaced apart on said snowboard, each of said devices comprising:

a base adapted to receive a sole of the boot and independent of the sole of the boot, said base adapted to be fixed in position to said snowboard and to extend substantially transversely, a front of said base being positioned closer to said frontal longitudinal side of said snowboard and a rear of said base being positioned closer to said rearward longitudinal side of said snowboard;

a dorsal support element for ensuring rear support of a lower part of a leg of a wearer of the boot, said dorsal support element being journalled on said base along a substantially transverse axis of the device for journalled movement of said dorsal support element in a forward direction of said device and in a rearward direction of said device;

at least one strap maintaining said dorsal support element substantially in contact with the boot at the lower part of the leg; and at least one brake, said brake having a structure that opposes said journalled movement in said rearward direction of said device with a determinate braking force, said structure of said at least one brake not opposing said journalled movement in said forward direction of said device with said determinate braking force.

16. A combination according to claim 15, wherein:

said dorsal support element is a unitary element.

17. A combination according to claim 15, wherein:

said dorsal support element comprises:

an arch journalled on said base along said substantially transverse axis of the device; and a shell, said arch and said shell being journalled with respect to one another along an axis extending substantially longitudinally of the device.

18. A combination according to claim 15, further comprising:

a stop mechanism to limit said journalled movement in said rearward direction.

19. A device for retaining a boot on a gliding board according to claim 15, further comprising:

at least one elastic means cooperating with said at least one brake.

20. A device for retaining a boot on a gliding board according to claim 19, wherein:

said at least one elastic means comprises an elastic means for constantly biasing said dorsal support element with respect to said base in said forward direction.

21. A device for retaining a boot on a gliding board adapted for snowboarding, said device comprising:

a dorsal support element for ensuring rear support of a lower part of a leg of a wearer of the boot;

a base adapted to be non-releasably attached to the gliding board and adapted to receive a sole of the boot, said dorsal support element being journalled to said base along a substantially transverse axis of the device for journalled movement of said dorsal support element in a forward direction and in a rearward direction;

at least one strap maintaining said dorsal support element substantially in contact with the boot at the lower part of the leg; and at least one brake, said brake having a structure that opposes said journalled movement in said rearward direction with a determinate braking force, said at least one brake having no structure for opposing said journalled movement in said forward direction with said determinate braking force.

22. A device for retaining a boot on a gliding board adapted to snowboarding, said device comprising:

a dorsal support element positioned rearwardly of the boot and rearwardly of a lower part of a leg of a wearer of the boot;

a base adapted to be attached to the gliding board, said base having a surface adapted to support a lower surface of a sole of the boot and a pair of laterally opposed upwardly extending portions;

a journal connection between said dorsal support element and each respective one of said upwardly extending portions of said base to secure said dorsal support element for journalled movement in a forward direction and in a rearward direction about a substantially transverse axis;

at least one strap maintaining said dorsal support element substantially in contact with the boot at the lower part of the leg; and at least one brake, said brake having a structure that opposes said journalled movement in said rearward direction with a determinate braking force, said brake having no structure for opposing said journalled movement in said forward direction with said determinate braking force.

* * * * *